US010767537B1

(12) United States Patent
Li et al.

(10) Patent No.: US 10,767,537 B1
(45) Date of Patent: Sep. 8, 2020

(54) HYDROCARBON INJECTOR DEFLECTOR ASSEMBLY FOR DIESEL EXHAUST SYSTEM

(71) Applicant: GM Global Technology Operations LLC, Detroit, MI (US)

(72) Inventors: Jianwen Li, Farmington Hills, MI (US); Shrikant N. Mathad, Bengaluru (IN); Ping Xiang, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/456,973

(22) Filed: Jun. 28, 2019

(51) Int. Cl.

| | |
|---|---|
| ***F01N 3/20*** | (2006.01) |
| ***F01N 3/28*** | (2006.01) |
| ***F02D 41/02*** | (2006.01) |
| ***F02D 41/30*** | (2006.01) |
| ***F02D 41/14*** | (2006.01) |
| ***F02D 41/38*** | (2006.01) |

(52) U.S. Cl.
CPC ..... *F01N 3/2892* (2013.01); *F02D 41/029* (2013.01); *F02D 41/1459* (2013.01); *F02D 41/3094* (2013.01); *F02D 41/3827* (2013.01)

(58) Field of Classification Search
CPC ..... F01N 3/2892; F01N 3/208; F01N 3/2066; F02D 41/029; F02D 41/3094; F02D 41/1459; F02D 41/3827
USPC ..... 60/317, 324
See application file for complete search history.

(56) References Cited

U.S. PATENT DOCUMENTS

| | | | | |
|---|---|---|---|---|
| 6,623,155 | B1 * | 9/2003 | Baron | B01F 5/0611 366/181.5 |
| 8,322,381 | B1 * | 12/2012 | Glanville | B01F 5/0616 138/37 |
| 8,360,630 | B2 * | 1/2013 | Schneider | B01F 5/0619 366/337 |
| 8,801,267 | B2 * | 8/2014 | Gentgen | F01N 3/2892 60/324 |
| 9,308,495 | B2 * | 4/2016 | Kimura | F01N 3/2892 |
| 9,587,545 | B2 * | 3/2017 | Venkataraghavan | F01N 3/2892 |
| 9,604,170 | B2 * | 3/2017 | Kimura | F01N 3/2892 |
| 9,726,064 | B2 * | 8/2017 | Alano | F01N 3/2066 |
| 9,938,878 | B2 * | 4/2018 | Ferront | F01N 3/2892 |
| 10,100,700 | B2 * | 10/2018 | Zhang | F01N 3/2892 |
| 2005/0229590 | A1 * | 10/2005 | Bruck | F01N 3/0222 60/295 |
| 2011/0146254 | A1 * | 6/2011 | Yi | F01N 3/2066 60/324 |
| 2011/0167810 | A1 * | 7/2011 | Lebas | F01N 3/2892 60/324 |

(Continued)

*Primary Examiner* — Thai Ba Trieu
*Assistant Examiner* — Dapinder Singh

(57) ABSTRACT

A hydrocarbon injector deflector for a diesel exhaust system includes a base plate having a first end linearly extending to a second end to define a first side and a second side. The base plate is arcuately formed such that the first side extends arcuately to the second side. The first end is disposed upstream of the exhaust system relative to the second end. The hydrocarbon deflector further includes a frame connected to the second end of the base plate and extends therefrom at a first angle. The frame has an opening formed through the frame. The opening defines an outer wall having an inner side of the frame. The deflector further includes a tab extending from the inner side at a second angle.

20 Claims, 3 Drawing Sheets

(56) References Cited

U.S. PATENT DOCUMENTS

| | | | | |
|---|---|---|---|---|
| 2012/0144812 | A1* | 6/2012 | Hyun | F01N 3/2892 60/301 |
| 2019/0388848 | A1* | 12/2019 | Kurpejovic | F01N 3/2892 |

* cited by examiner

HYDROCARBON INJECTOR DEFLECTOR ASSEMBLY FOR DIESEL EXHAUST SYSTEM

INTRODUCTION

The present disclosure relates to exhaust systems and, more particularly, a hydrocarbon injector deflector for a diesel exhaust system of a vehicle.

Internal combustion engines produce particulate matter which is considered a waste byproduct of combustion and a concern to the environment. To reduce particulate matter exiting the exhaust system of a vehicle, a Diesel Particulate Filter (DPF) traps the soot/particulates in the exhaust and needs to be regenerated regularly at a high exhaust gas temperature of above 600 degC. Typically, the high exhaust temperature is generated in Diesel Oxidation Catalysts (DOC) by burning hydrocarbons (diesel fuel) vapors. The hydrocarbons are introduced into exhaust through a Hydro-Carbon Injector (HCl) at around 5 bar pressure. The HC comes out of HCl at a form of many HC droplets that need to be vaporized and mixed with exhaust flow before they get into the DOC. Improvements continue to be made to increase DPF regeneration efficiency yet maintaining competitive vehicle fuel efficiency.

Thus, while current diesel exhaust systems may achieve their intended purpose, there is a need for a new and improved system.

SUMMARY

According to one embodiment of the present disclosure, a hydrocarbon injector deflector for a diesel exhaust system is provided. In this embodiment, the deflector comprises a base plate having a first end linearly extending to a second end to define a first side and a second side. The base plate is arcuately formed such that the first side extends arcuately to the second side. The first end is disposed upstream of the exhaust system relative to the second end.

In this embodiment, the hydrocarbon deflector further comprises a frame connected to the second end of the base plate and extends therefrom at a first angle. The frame has an opening formed through the frame. Moreover, the window defines an outer wall having an inner side of the frame. The deflector further comprises a tab extending from the inner side at a second angle.

In one embodiment, the base plate comprises at least one slit formed therethrough. In this aspect, the slit formed through the base plate defines a wing for hydrocarbon droplet impingement. In another aspect, the at least one slit is a pair of grooves formed laterally between the first and second sides to define a pair of wings arcuately extending adjacent the second end of the base plate.

In another embodiment, the frame includes a first portion and a second portion. In this aspect, the first portion has a neck extending therefrom and is disposed on the second end of the base plate. Moreover, the second portion has at least one contact portion extending therefrom for mounting the deflector.

In one embodiment, the outer wall of the frame includes at least one cut formed thereon from the first portion to a length adjacent the second portion. The cut formed on the frame defines a strip extending from the second portion at a third angle. In this example, the at least one cut is a pair of cuts formed on the outer wall to define a pair of strips extending from the second portion of the frame at the third angle.

In another aspect of the present disclosure, a hydrocarbon injector deflector assembly for a diesel exhaust system of a vehicle having an exhaust flow is provided. The assembly comprises an exhaust column and a hydrocarbon injector disposed to and in fluid communication with the exhaust column. In this embodiment, the hydrocarbon injector is configured to introduce hydrocarbons to be mixed with the exhaust flow. The assembly further comprises a mixer disposed within the exhaust column downstream from the hydrocarbon injector. The assembly further comprises a Diesel Oxidation Catalyst (DOC) and a Diesel Particulate Filter (DPF) connect to and in fluid communication with the exhaust column. Moreover, the mixer is configured to mix HC droplets and exhaust flow and distribute them uniformly before the DOC.

In this aspect, the assembly further includes a hydrocarbon injector deflector comprising a base plate, a frame and a tab. In this embodiment, the base plate is disposed in the exhaust column between the hydrocarbon injector and the mixer. Moreover, the base plate has a first end linearly extending to a second end to define a first side and a second side. The base plate is arcuately formed such that the first side extends arcuately to the second side. The base plate is disposed adjacent the hydrocarbon injector. Moreover, the first end is disposed upstream relative to the second end.

The assembly further comprises a frame connected to the second end of the base plate and extending therefrom at a first angle. The frame has an opening or window formed therethrough. The window defines an outer wall having an inner side of the frame. The assembly further comprises a tab extending from the inner side of the frame at a second angle.

In one embodiment, the base plate comprises at least one slit formed therethrough. The slit defines a wing for hydrocarbon droplet impingement. The at least one slit is a pair of grooves formed laterally between the first and second sides to define a pair of wings arcuately extending adjacent the second end of the base plate.

In another embodiment, the frame includes a first portion and a second portion. The first portion has a neck extending therefrom and is disposed on the second end of the base plate. The second portion has at least one contact portion extending therefrom for mounting the deflector. In this embodiment, the outer wall of the frame includes at least one cut formed thereon from the first portion to a length adjacent the second portion, defining a strip extending from the second portion at a third angle. Moreover, the at least one cut is a pair of cuts formed on the outer wall to define a pair of strips extending from the second portion of the frame at the third angle.

In another embodiment, the frame is connected to the second end of the base plate and extends downstream therefrom at a first angle. Moreover, the first angle is between about 10 to about 15 degrees relative to a cross-section normal to the exhaust column for hydrocarbon droplet impingement and redistribution at low to medium exhaust flow. In one embodiment, the tab extends downstream from the inner side of the frame at a second angle, the second angle being between about 25 degrees and about 45 degrees relative to a cross-section normal to the exhaust column for hydrocarbon droplet impingement and redistribution at high exhaust flow.

In yet another aspect of the present disclosure, a vehicle having a diesel exhaust system with a hydrocarbon injector deflector assembly for exhaust flow is provided. In one embodiment, the vehicle comprises a chassis and a body supported by the chassis. The body includes a motor compartment and an occupant zone. Moreover, the vehicle further comprises a diesel exhaust system comprising an exhaust column and a hydrocarbon injector disposed to and in fluid communication with the exhaust column. The hydrocarbon injector is configured to introduce hydrocarbons to be mixed with the exhaust flow. The diesel exhaust system further comprises a mixer disposed within the exhaust column downstream from the hydrocarbon injector. In this example, the mixer is configured to distribute exhaust flow. The diesel exhaust system further comprises a Diesel Oxidation Catalyst (DOC) a diesel particulate filter (DPF) connect to and in fluid communication with the exhaust column.

In this aspect, the diesel exhaust system further comprises a hydrocarbon injector deflector. The deflector comprises a base plate, a frame and a tab. The base plate is disposed in the exhaust column between the hydrocarbon injector and the mixer. Moreover, the base plate has a first end linearly extending to a second end to define a first side and a second side. In this embodiment, the base plate is arcuately formed such that the first side extends arcuately to the second side. The base plate is disposed adjacent the hydrocarbon injector. Furthermore, the first end is disposed upstream relative to the second end.

In this example, the frame is connected to the second end of the base plate and extends therefrom at a first angle. The frame has a window opening formed therethrough wherein the window defines an outer wall having an inner side of the frame. Moreover, the tab extends from the inner side of the frame at a second angle.

In one embodiment, the base plate comprises at least one slit formed therethrough, defining a wing for hydrocarbon droplet impingement. Moreover, the frame includes a first portion and a second portion. The first portion has a neck extending therefrom and is disposed on the second end of the base plate. The second portion has at least one contact portion extending therefrom for mounting the deflector to the column.

In another embodiment, the outer wall of the frame includes at least one cut formed thereon from the first portion to a length adjacent the second portion, defining a strip extending from the second portion at a third angle. Moreover, the frame is connected to the second end of the base plate and extends downstream therefrom at a first angle. The first angle is between about 10 to about 15 degrees relative to a cross-section normal to the exhaust column for hydrocarbon droplet impingement and redistribution at low to medium exhaust flow.

In another embodiment, the tab extends downstream from the inner side of the frame at a second angle. The second angle is between about 25 degrees and about 45 degrees relative to a cross-section normal to the exhaust column for hydrocarbon droplet impingement and redistribution at high exhaust flow.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

According to embodiments of the present disclosure, a hydrocarbon injector deflector for a diesel exhaust system of a vehicle having an exhaust flow is provided. The deflector is designed to have features that can distribute hydrocarbon droplets in the exhaust flow more uniformly at different exhaust flow rates across the exhaust flow cross-section before the hydrocarbon is mixed downstream by a mixer. A more uniform hydrocarbon distribution before the mixer enables a reduction in mixing/vaporization energy from the mixer and a reduction in pressure drop while still maintaining good mixing performances.

Figure 1:
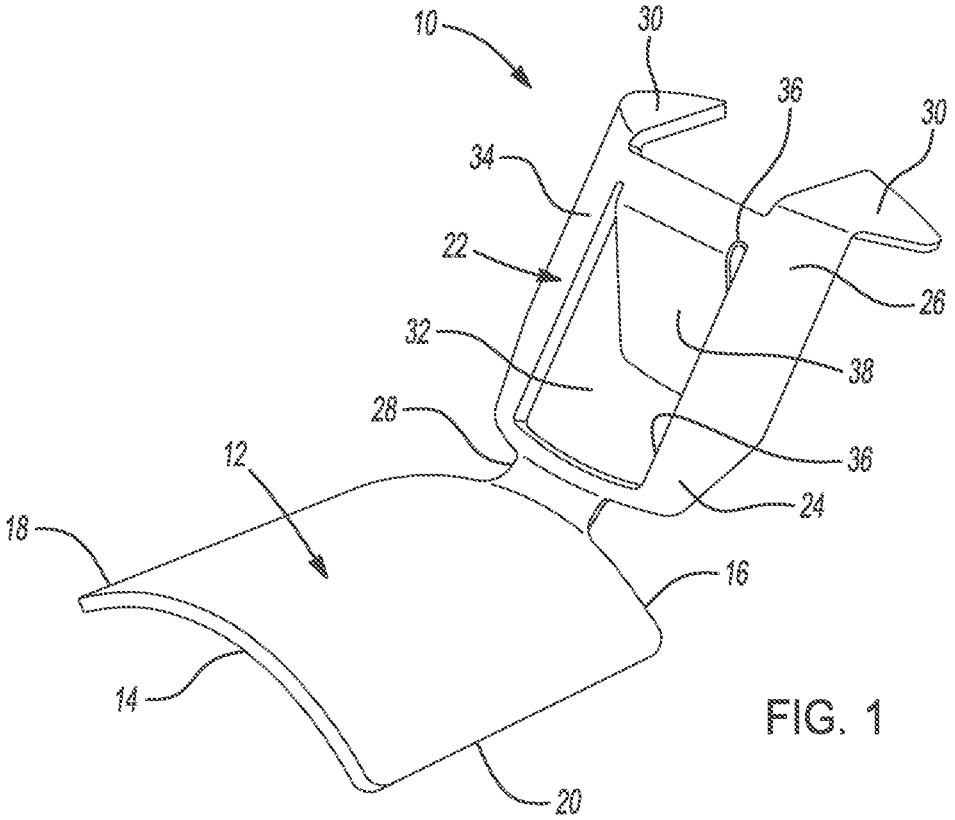
FIG. 1 is a perspective view of a hydrocarbon injector deflector in accordance with one embodiment of the present disclosure.
Figure 2:
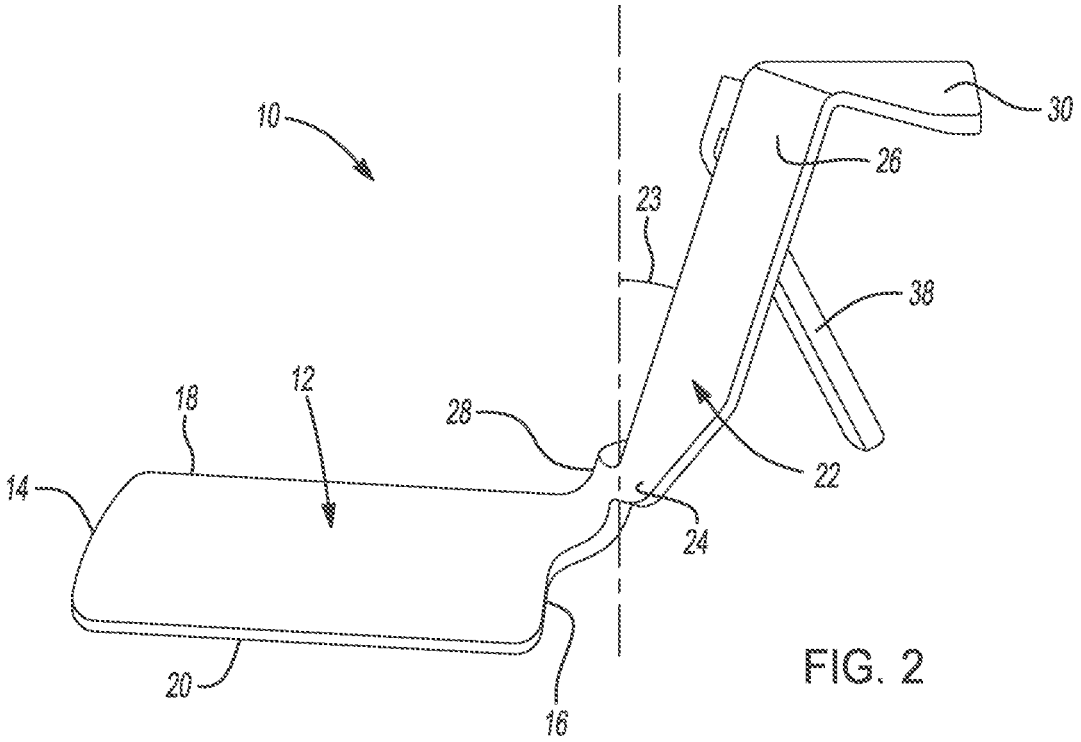
FIG. 2 is side view of the hydrocarbon injector deflector of FIG. 1.

FIGS. 1 and 2 illustrate a hydrocarbon injector deflector 10 for a diesel exhaust system of a vehicle having an exhaust flow in accordance with one embodiment of the present disclosure. As shown, the deflector 10 comprises a base plate 12 having a first end 14 linearly extending to a second end 16 to define a first side 18 and a second side 20. The base plate 12 is arcuately formed such that the first side 18 extends arcuately to the second side 20. The first end 14 is to be disposed upstream of the exhaust system relative to the second end 16. As discussed in greater detail below, the base plate 12 preferably allows for hydrocarbon droplet impingement/redistribution at low to medium exhaust flow rates.

In this embodiment, the hydrocarbon deflector 10 further comprises a frame 22 connected to the second end 16 of the base plate 12 and extends therefrom at a first angle 23. As shown in FIG. 1, the frame 22 includes a first portion 24 and a second portion 26. In this embodiment, the first portion 24 has a neck 28 extending therefrom and is disposed on or attached to the second end 16 of the base plate 12. Moreover, the second portion 26 has at least one contact portion 30 extending therefrom for mounting the deflector 10 to the exhaust system.

Preferably, the frame 22 has an opening or window 32 formed through the frame 22. Moreover, the window 32 defines an outer wall 34 having an inner side 36 of the frame 22. As shown, the deflector 10 further comprises a tab 38 extending from the inner side at a second angle. As discussed in greater detail below, the frame 22 along with the tab 38 preferably allows for hydrocarbon droplet impingement/redistribution at relatively high exhaust flow rates.

Figure 3:
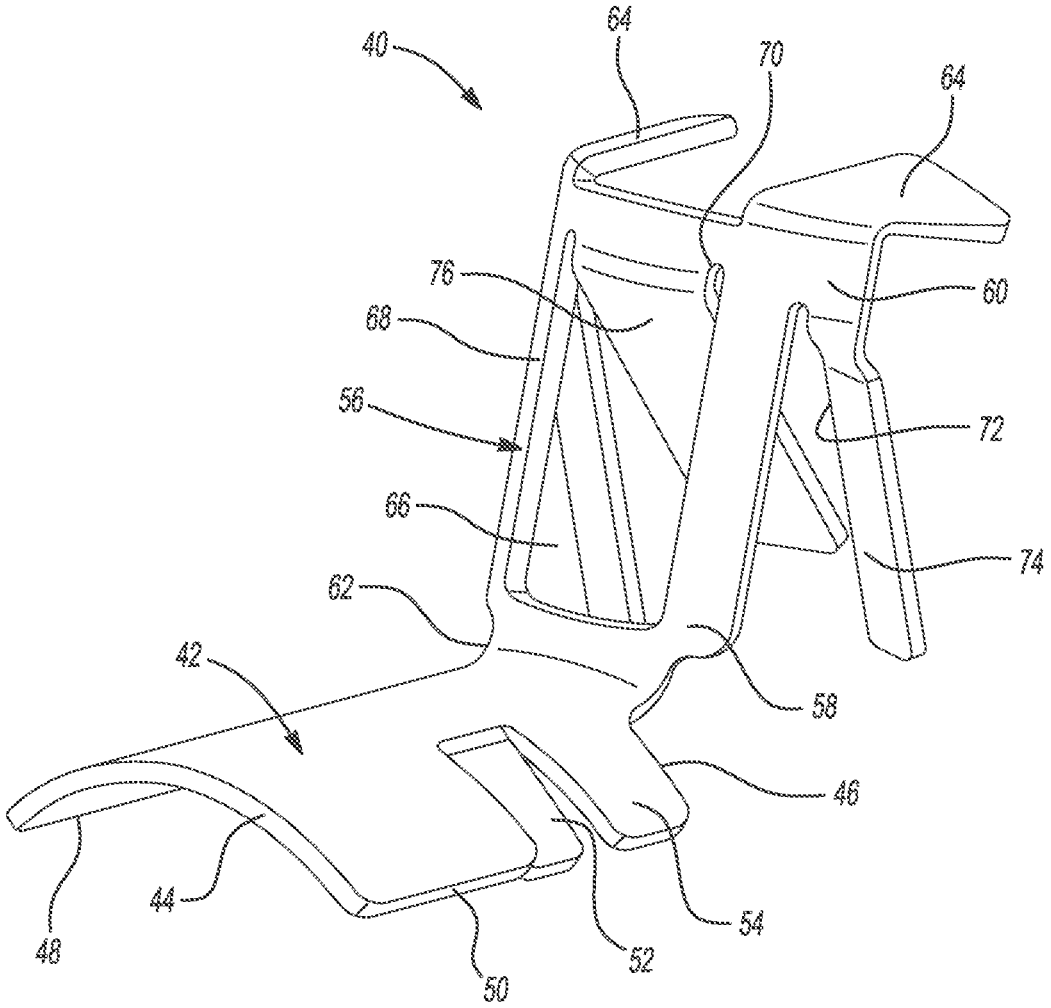
FIG. 3 is a perspective view of a hydrocarbon injector deflector in accordance with another embodiment of the present disclosure.

FIG. 3 depicts a hydrocarbon injector deflector 40 for a diesel exhaust system of a vehicle having an exhaust flow in accordance with another embodiment of the present disclosure. As shown, the deflector 40 comprises a base plate 42 having a first end 44 linearly extending to a second end 46 to define a first side 48 and a second side 50. The base plate 42 is arcuately formed such that the first side 48 extends arcuately to the second side 50. The first end 44 is to be disposed upstream of the exhaust system relative to the second end 46. As discussed in greater detail below, the base plate 42 preferably allows for hydrocarbon droplet impingement/redistribution at low to medium exhaust flow rates.

In this embodiment, the base plate 42 preferably comprises at least one slit 52 or groove formed therethrough. Preferably, the slit 52 is formed through the base plate 42 and defines a wing 54 for further enhanced hydrocarbon droplet impingement. As depicted in FIG. 3, the base plate 42 comprises a pair of slits formed laterally between the first and second sides to define a pair of wings arcuately extending adjacent the second end 46 of the base plate 42.

In this embodiment, the hydrocarbon deflector 40 further comprises a frame 56 connected to the second end 46 of the base plate 42 and extends therefrom at a first angle 57. As shown in FIG. 3, the frame 56 includes a first portion 58 and a second portion 60. In this embodiment, the first portion 58 has a neck 62 extending therefrom and is disposed on or attached to the second end 46 of the base plate 42. Moreover, the second portion 60 has at least one contact portion 64 extending therefrom for mounting the deflector 40 to the exhaust system.

Preferably, the frame 56 has an opening 66 or window formed through the frame 56. Moreover, the window defines an outer wall 68 having an inner side 70 of the frame 56. As shown, the outer wall 68 of the frame 56 includes at least one cut 72 formed thereon from the first portion 58 to a length adjacent the second portion 60. The cut 72 formed on the frame 56 defines a strip 74 extending from the second portion 60 at a third angle. The third angle may be defined as an angle relative to the cross-section of the exhaust flow. The at least one cut 72 is preferably a pair of cuts formed on the outer wall 68 to define a pair of strips extending from the second portion 60 of the frame 56 at the third angle.

As shown, the deflector 40 further comprises a tab extending from the inner side 70 at a second angle. As discussed in greater detail below, the frame 56 along with the tab preferably allows for hydrocarbon droplet impingement/redistribution for relatively high exhaust flow rates.

Figure 4A:
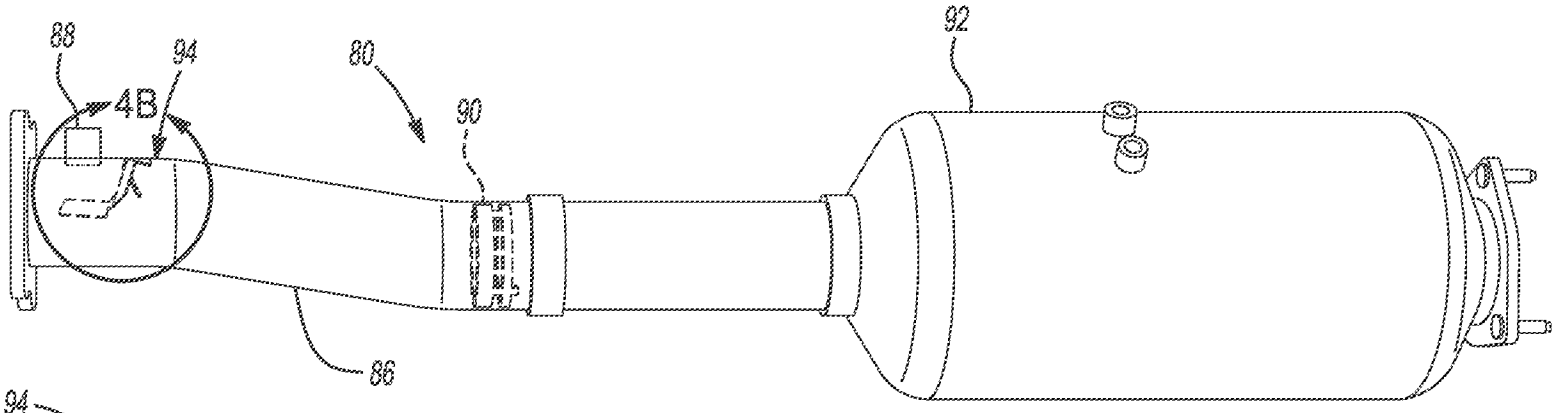
FIG. 4A is a schematic view of a hydrocarbon injector deflector assembly for an exhaust system of a vehicle according to an exemplary embodiment.
Figure 4B:
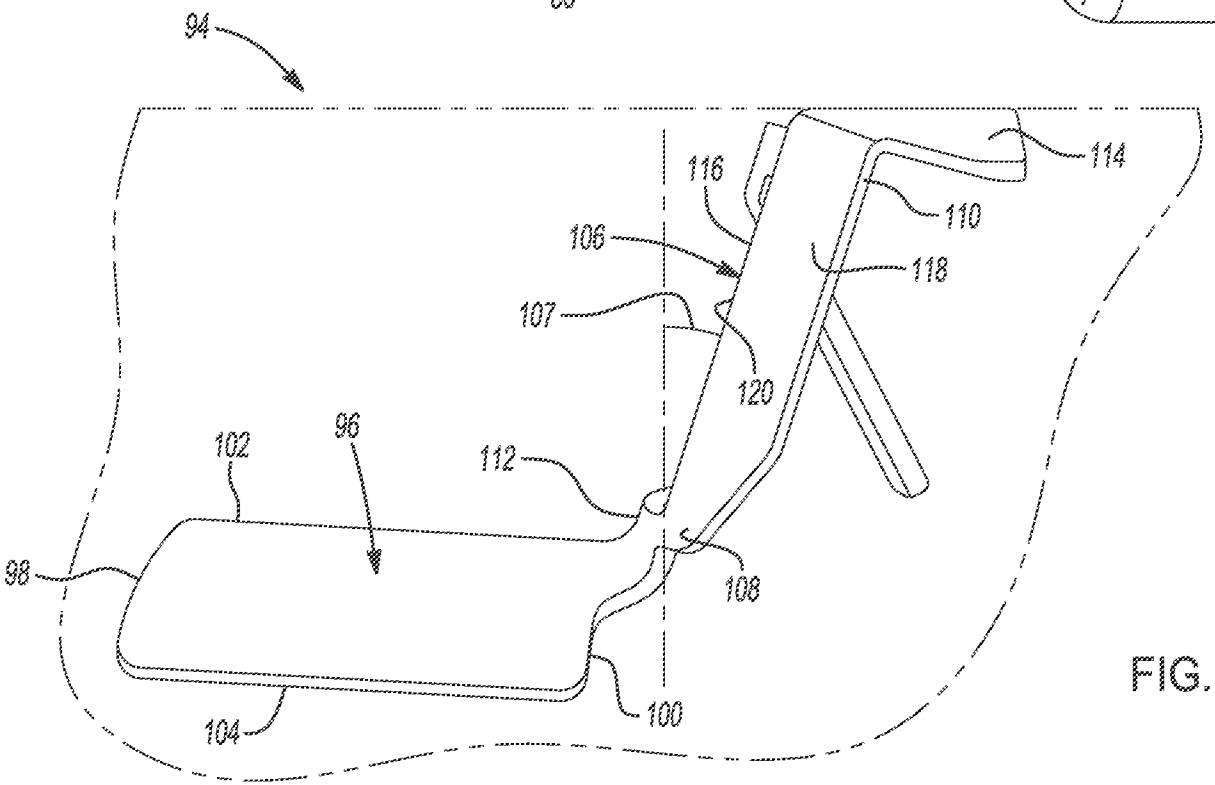
FIG. 4B is an enlarged view of the hydrocarbon injector deflector assembly shown in circle 4B in FIG. 4A.

FIGS. 4A and 4B illustrate a hydrocarbon injector deflector 94 assembly 80 for a diesel exhaust system of a vehicle having an exhaust flow in accordance with another embodiment of the present disclosure. As shown, the assembly 80 comprises an exhaust column 86 and a hydrocarbon injector 88 disposed to and in fluid communication with the exhaust column 86. In this embodiment, the hydrocarbon injector 88 is configured to introduce hydrocarbons to be mixed with the exhaust flow. The assembly 80 further comprises a mixer 90 disposed within the exhaust column 86 downstream from the hydrocarbon injector 88. Moreover, the mixer 90 is configured to distribute exhaust flow. The assembly 80 further comprises a diesel particulate filter 92 disposed downstream from the mixer 90. The diesel particulate filter 92 is connect to and in fluid communication with the exhaust column 86.

In this embodiment, the assembly 80 further includes a hydrocarbon injector deflector 94 similar to the deflector shown in FIG. 1. As shown, the deflector 94 comprises a base plate 96, a frame 106 and a tab. In this embodiment, the base plate 96 is disposed in the exhaust column 86 between the hydrocarbon injector 88 and the mixer 90. Moreover, the base plate 96 has a first end 98 linearly extending to a second end 100 to define a first side 102 and a second side 104. The base plate 96 is arcuately formed such that the first side 102 extends arcuately to the second side 104. The base plate 96 is disposed adjacent the hydrocarbon injector 88. Moreover, the first end 98 is disposed upstream relative to the second end 100.

Preferably, the base plate 96 is disposed adjacent the injector 88 to provide hydrocarbon impingement as hydrocarbons are dispersed from the injector 88 thereby providing enhanced redistribution of hydrocarbons within the exhaust flow. It is to be understood that the base plate 96 is configured for impingement of hydrocarbons at low to medium exhaust flows. Thus, the base plate 96 preferably allows for hydrocarbon droplet impingement/redistribution at low to medium exhaust flow rates.

As shown, the assembly 80 further comprises a frame 106 connected to the second end 100 of the base plate 96 and extending therefrom at a first angle 107. In this embodiment, the frame 106 includes a first portion 108 and a second portion 110. The first portion 108 has a neck 112 extending therefrom and is disposed on the second end 100 of the base plate 96. The second portion 110 has at least one contact portion 114 extending therefrom for mounting the deflector 94 to the exhaust column 86. Preferably, the deflector 94 is mounted to the exhaust column 86 adjacent to the injector 88. Moreover, the frame 106 has an opening or window 116 formed therethrough. The window 116 defines an outer wall 118 having an inner side 120 of the frame 106.

As mentioned above, the frame 106 is connected to the second end 100 of the base plate 96 by way of the neck 112 and extends downstream therefrom at a first angle 107. Moreover, the first angle 107 is preferably between about 10 to about 15 degrees relative to a cross-section normal to the exhaust column 86 for hydrocarbon droplet impingement and redistribution at low to medium exhaust flow. In this embodiment, the tab extends downstream from the inner side 120 of the frame 106 at a second angle 109. Preferably, the second angle 109 is between about 25 degrees and about 45 degrees relative to a cross-section normal to the exhaust column 86 for hydrocarbon droplet impingement and redistribution at high exhaust flow.

Preferably, the frame 106 is positioned in the column 86 within an area of the exhaust flow cross-section such that anticipated high exhaust flow contacts the tab. The tab is configured to provide contact with hydrocarbons for enhanced hydrocarbon impingement within the exhaust flow. It is to be understood that the tab is configured for impingement of hydrocarbons at relatively high exhaust flows. Thus, the tab preferably allows for hydrocarbon droplet impingement/redistribution at high exhaust flow rates.

In one embodiment, the deflector 94 may be disposed adjacent the injector 88 such that the base plate 96 is positioned between about 15 millimeters (mm) and 45 mm therefrom, and the frame 106 is positioned between about 25 mm and 45 mm from the injector 88.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A hydrocarbon injector deflector for a diesel exhaust system, the hydrocarbon injector deflector comprising:

a base plate having a first end linearly extending to a second end to define a first side and a second side, the base plate being arcuately formed such that the first side extends arcuately to the second side, the first end being disposed upstream of the exhaust system relative to the second end;

a frame connected to the second end of the base plate and extending therefrom at a first angle, the frame having an opening formed therethrough, the opening defining an outer wall having an inner side of the frame; and a tab extending from the inner side at a second angle.

2. The hydrocarbon injector deflector of claim 1 wherein the base plate comprises at least one slit formed therethrough, defining a wing for hydrocarbon droplet impingement.

3. The hydrocarbon injector deflector of claim 2 wherein the at least one slit is a pair of slits formed laterally between the first and second sides to define a pair of wings arcuately extending adjacent the second end of the base plate.

4. The hydrocarbon injector deflector of claim 1 wherein the frame includes a first portion and a second portion, the first portion having a neck extending therefrom and disposed on the second end of the base plate, the second portion having at least one contact portion extending therefrom for mounting the deflector.

5. The hydrocarbon injector deflector of claim 4 wherein the outer wall of the frame includes at least one cut formed thereon from the first portion to a length adjacent the second portion, defining a strip extending from the second portion at a third angle.

6. The hydrocarbon injector deflector of claim 5 wherein the at least one cut is a pair of cuts formed on the outer wall to define a pair of strips extending from the second portion of the frame at the third angle.

7. A hydrocarbon injector deflector assembly for a diesel exhaust system of a vehicle having an exhaust flow, the assembly comprising:

an exhaust column;

a hydrocarbon injector disposed to and in fluid communication with the exhaust column, the hydrocarbon injector configured to introduce hydrocarbons to be mixed with the exhaust flow;

a mixer disposed within the exhaust column downstream from the hydrocarbon injector, the mixer configured to mix hydrocarbon and exhaust flow and distribute them uniformly; and a diesel particulate filter disposed downstream from the mixer, the diesel particulate filter being connect to and in fluid communication with the exhaust column;

a hydrocarbon injector deflector comprising:

a base plate disposed in the exhaust column between the hydrocarbon injector and the mixer, the base plate having a first end linearly extending to a second end to define a first side and a second side, the base plate being arcuately formed such that the first side extends arcuately to the second side, the base plate being disposed adjacent the hydrocarbon injector, the first end being disposed upstream relative to the second end;

a frame connected to the second end of the base plate and extending therefrom at a first angle, the frame having an opening formed therethrough, the window defining an outer wall having an inner side of the frame; and a tab extending from the inner side of the frame at a second angle.

8. The hydrocarbon injector deflector assembly of claim 7 wherein the base plate comprises at least one slit formed there through, defining a wing for hydrocarbon droplet impingement.

9. The hydrocarbon injector deflector assembly of claim 8 wherein the at least one slit is a pair of grooves formed laterally between the first and second sides to define a pair of wings arcuately extending adjacent the second end of the base plate.

10. The hydrocarbon injector deflector assembly of claim 7 wherein the frame includes a first portion and a second portion, the first portion having a neck extending therefrom and disposed on the second end of the base plate, the second portion having at least one contact portion extending therefrom for mounting the deflector.

11. The hydrocarbon injector deflector assembly of claim 10 wherein the outer wall of the frame includes at least one cut formed thereon from the first portion to a length adjacent the second portion, defining a strip extending from the second portion at a third angle.

12. The hydrocarbon injector deflector assembly of claim 11 wherein the at least one cut is a pair of cuts formed on the outer wall to define a pair of strips extending from the second portion of the frame at the third angle.

13. The hydrocarbon injector deflector assembly of claim 7 wherein the frame is connected to the second end of the base plate and extends downstream therefrom at the first angle, the first angle being between about 10 to about 15 degrees relative to a cross-section normal to the exhaust column for hydrocarbon droplet impingement and redistribution at low to medium exhaust flow.

14. The hydrocarbon injector deflector assembly of claim 7 wherein the tab extends downstream from the inner side of the frame at the second angle, the second angle being between about 25 degrees and about 45 degrees relative to a cross-section normal to the exhaust column for hydrocarbon droplet impingement and redistribution at high exhaust flow.

15. A vehicle having a diesel exhaust system with a hydrocarbon injector deflector assembly for exhaust flow, the vehicle comprising:

a chassis;

a body supported by the chassis, the body including a motor compartment and an occupant zone; and a diesel exhaust system comprising:

an exhaust column;

a hydrocarbon injector disposed to and in fluid communication with the exhaust column, the hydrocarbon injector configured to introduce hydrocarbons to be mixed with the exhaust flow;

a mixer disposed within the exhaust column downstream from the hydrocarbon injector, the mixer configured to distribute exhaust flow; and a diesel oxidation catalyst and a diesel particulate filter disposed downstream from the mixer, the diesel oxidation catalyst and diesel particulate filter being connect to and in fluid communication with the exhaust column;

a hydrocarbon injector deflector comprising:

a base plate disposed in the exhaust column between the hydrocarbon injector and the mixer, the base plate having a first end linearly extending to a second end to define a first side and a second side, the base plate being arcuately formed such that the first side extends arcuately to the second side, the base plate being disposed adjacent the hydrocarbon injector, the first end being disposed upstream relative to the second end;

a frame connected to the second end of the base plate and extending therefrom at a first angle, the frame having an opening formed therethrough, the window defining an outer wall having an inner side of the frame; and a tab extending from the inner side of the frame at a second angle.

16. The vehicle of claim 15 wherein the base plate comprises at least one slit formed therethrough, defining a wing for hydrocarbon droplet impingement.

17. The vehicle of claim 15 wherein the frame includes a first portion and a second portion, the first portion having a neck extending therefrom and disposed on the second end of the base plate, the second portion having at least one contact portion extending therefrom for mounting the deflector to the exhaust column.

18. The vehicle of claim 17 wherein the outer wall of the frame includes at least one cut formed thereon from the first portion to a length adjacent the second portion, defining a strip extending from the second portion at a third angle.

19. The vehicle of claim 15 wherein the frame is connected to the second end of the base plate and extends downstream therefrom at the first angle, the first angle being between about 10 to about 15 degrees relative to a cross-section normal to the exhaust column for hydrocarbon droplet impingement and redistribution at low to medium exhaust flow.

20. The vehicle of claim 15 wherein the tab extends downstream from the inner side of the frame at the second angle, the second angle being between about 25 degrees and about 45 degrees relative to a cross-section normal to the exhaust column for hydrocarbon droplet impingement and redistribution at high exhaust flow.

* * * * *